US007875563B2

(12) United States Patent
Ardiff et al.

(10) Patent No.: US 7,875,563 B2
(45) Date of Patent: Jan. 25, 2011

(54) METHOD TO CREATE AN ENVIRONMENTALLY RESISTANT SOFT ARMOR COMPOSITE

(75) Inventors: Henry G. Ardiff, Chesterfield, VA (US); Ralf Klein, Midlothian, VA (US); Brian D. Arvidson, Chester, VA (US); Ashok Bhatnagar, Richmond, VA (US); Lori L. Wagner, Richmond, VA (US)

(73) Assignee: Honeywell International Inc., Morristown, NJ (US)

( * ) Notice: Subject to any disclaimer, the term of this patent is extended or adjusted under 35 U.S.C. 154(b) by 749 days.

(21) Appl. No.: 11/729,258

(22) Filed: Mar. 28, 2007

(65) Prior Publication Data

US 2008/0241494 A1 Oct. 2, 2008

(51) Int. Cl.
*B32B 27/04* (2006.01)

(52) U.S. Cl. ..... 442/134; 442/135; 2/2.5

(58) Field of Classification Search ..... 442/65, 442/66, 134, 135; 428/911
See application file for complete search history.

(56) References Cited

U.S. PATENT DOCUMENTS

| | | | | |
|---|---|---|---|---|
| 4,680,221 | A | 7/1987 | Murayama et al. | 442/126 |
| 5,587,230 | A * | 12/1996 | Lin et al. | 442/135 |
| 6,326,094 | B1 | 12/2001 | Asano et al. | 428/38 |
| 6,335,094 | B1 | 1/2002 | Owaki et al. | 428/374 |
| 6,642,159 | B1 | 11/2003 | Bhatnagar et al. | |
| 6,838,401 | B1 | 1/2005 | Murayama et al. | 442/335 |
| 7,407,899 | B2 | 8/2008 | Milliken et al. | |
| 2004/0018787 | A1 | 1/2004 | Bullock et al. | |

FOREIGN PATENT DOCUMENTS

| | | | |
|---|---|---|---|
| WO | 0196695 | A1 | 12/2001 |
| WO | 0214408 | A2 | 2/2002 |
| WO | 2006132852 | A1 | 12/2006 |

* cited by examiner

*Primary Examiner*—Arti Singh-Pandey
(74) *Attorney, Agent, or Firm*—Erika S. Wilson

(57) ABSTRACT

Fibrous substrates and articles that retain their superior ballistic resistance performance after exposure to liquids such as sea water and organic solvents, such as gasoline and other petroleum-based products. The fibrous substrates are coated with a multilayer polymeric coating including at least two different polymer layers wherein at least one of the layers is formed from a fluorine-containing polymer.

8 Claims, 1 Drawing Sheet

METHOD TO CREATE AN ENVIRONMENTALLY RESISTANT SOFT ARMOR COMPOSITE

BACKGROUND OF THE INVENTION

1. Field of the Invention

This invention relates to ballistic resistant articles having excellent resistance to deterioration due to liquid exposure. More particularly, the invention pertains to ballistic resistant fabrics and articles that retain their superior ballistic resistance performance after exposure to liquids such as sea water and organic solvents, such as gasoline and other petroleum-based products.

2. Description of the Related Art

Ballistic resistant articles containing high strength fibers that have excellent properties against projectiles are well known. Articles such as bullet resistant vests, helmets, vehicle panels and structural members of military equipment are typically made from fabrics comprising high strength fibers. High strength fibers conventionally used include polyethylene fibers, aramid fibers such as poly(phenylenediamine terephthalamide), graphite fibers, nylon fibers, glass fibers and the like. For many applications, such as vests or parts of vests, the fibers may be used in a woven or knitted fabric. For other applications, the fibers may be encapsulated or embedded in a polymeric matrix material to form woven or non-woven rigid or flexible fabrics.

Various ballistic resistant constructions are known that are useful for the formation of hard or soft armor articles such as helmets, panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

Hard or rigid body armor provides good ballistic resistance, but can be very stiff and bulky. Accordingly, body armor garments, such as ballistic resistant vests, are preferably formed from flexible or soft armor materials. However, while such flexible or soft materials exhibit excellent ballistic resistance properties, they also generally exhibit poor resistance to liquids, including fresh water, seawater and organic solvents, such as petroleum, gasoline, gun lube and other solvents derived from petroleum. This is problematic because the ballistic resistance performance of such materials is generally known to deteriorate when exposed to or submerged in liquids. Further, while it has been known to apply a protective film to a fabric surface to enhance fabric durability and abrasion resistance, as well as water or chemical resistance, these films add weight to the fabric. Accordingly, it would be desirable in the art to provide soft, flexible ballistic resistant materials that perform at acceptable ballistic resistance standards after being contacted with or submerged in a variety of liquids, and also have superior durability without the use of a protective surface film in addition to a binder polymer coating.

Few conventional binder materials, commonly referred to in the art as polymeric "matrix" materials, are capable of providing all the desired properties discussed herein. Fluorine-containing polymers are desirable in other arts due to their resistance to dissolution, penetration and/or transpiration by sea water and resistance to dissolution, penetration and/or transpiration by one or more organic solvents, such as diesel gasoline, non-diesel gasoline, gun lube, petroleum and organic solvents derived from petroleum. In the art of ballistic resistant materials, it has been discovered that fluorine-containing coatings advantageously contribute to the retention of the ballistic resistance properties of a ballistic resistant fabric after prolonged exposure to potentially harmful liquids, eliminating the need for a protective surface film to achieve such benefits. More particularly, it has been found that excellent ballistic and environmental properties are achieved when coating ballistic resistant fibrous materials with both a layer of a conventional polymeric matrix material and a layer of a fluorine-containing polymer.

Accordingly, the present invention provides a ballistic resistant fabric which is formed with multiple layers of polymeric binder materials. At least one of the layers comprises a fluorine-containing polymer that offers the desired protection from liquids, as well as heat and cold resistance, and resistance to abrasion and wear, while maintaining good flexibility and superior ballistic resistance properties. The polymer layers are preferably contacted with each other as liquids to facilitate their miscibility and adhesion at their contact interfaces.

SUMMARY OF THE INVENTION

The invention provides a fibrous composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a first polymer layer on a surface of said one or more fibers, said first polymer layer comprising a first polymer, and a second polymer layer on said first polymer layer, said second polymer layer comprising a second polymer, wherein the first polymer and the second polymer are different, and wherein at least one of the first polymer and the second polymer comprises fluorine.

The invention also provides a method of forming a fibrous composite comprising:

a) providing at least one fibrous substrate having a surface; wherein said at least one fibrous substrate comprises one or more fibers having a tenacity of about 7 g/denier or more and a tensile modulus of about 150 g/denier or more;

b) applying a first polymer layer onto the surface of the at least one fibrous substrate, said first polymer layer comprising a first polymer;

c) thereafter, applying a second polymer layer onto the first polymer layer, said second polymer layer comprising a second polymer;

and wherein the first polymer and the second polymer are different; and wherein at least one of the first polymer and the second polymer comprises fluorine.

Also provided are articles formed from the fibrous composites of the invention.

DETAILED DESCRIPTION OF THE INVENTION

Figure 1:
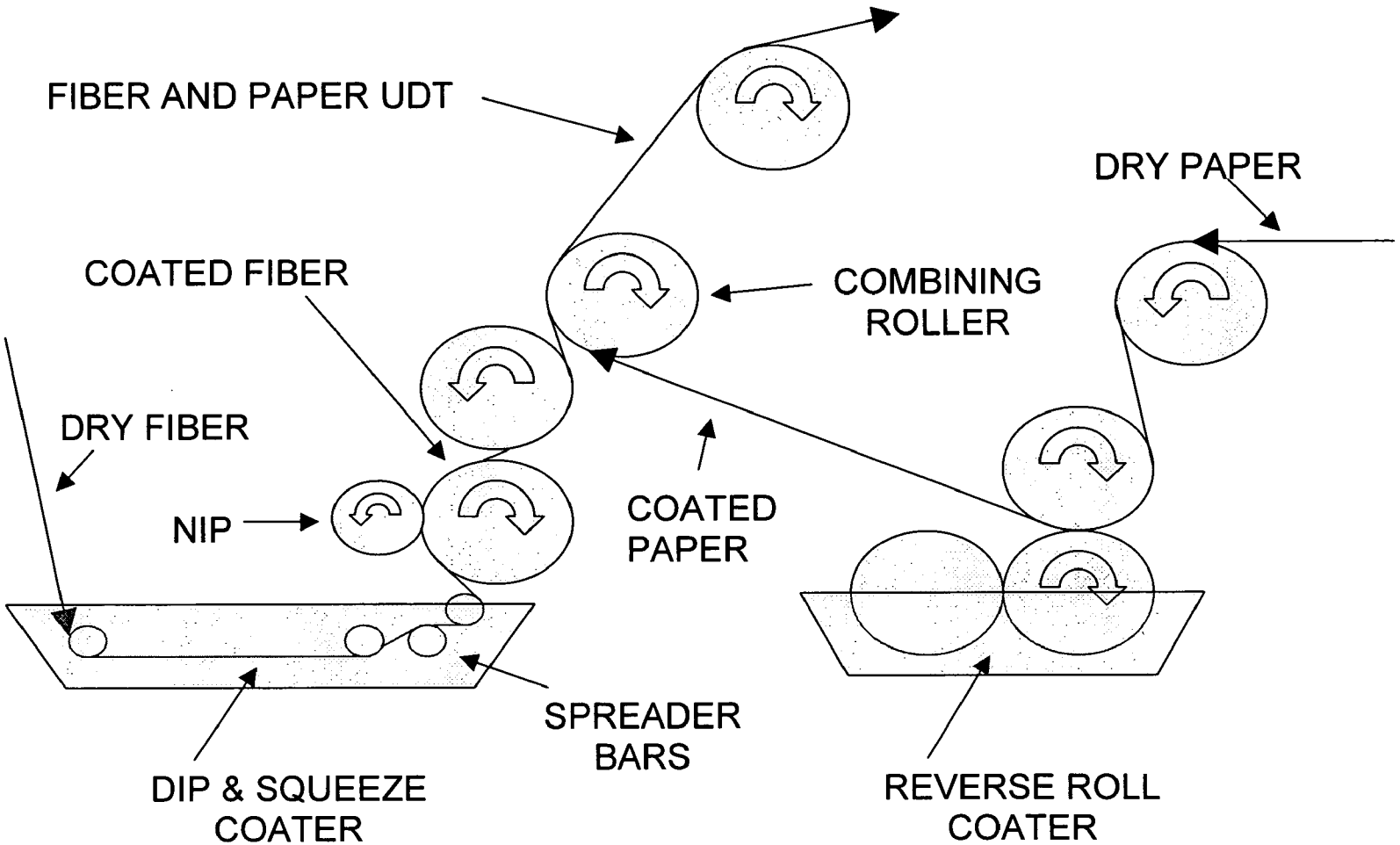
FIG. 1 is a schematic representation illustrating a process for applying a multilayer coating onto a fibrous substrate utilizing a hybrid coating technique.

The invention presents fibrous composites and articles that retain superior ballistic penetration resistance after exposure to water, particularly sea water, and organic solvents, particularly solvents derived from petroleum such as gasoline. Particularly, the invention provides fibrous composites formed by applying a multilayer coating onto at least one fibrous substrate. A fibrous substrate is considered to be a single fiber in most embodiments, but may alternately be considered a fabric when a plurality of fibers are united as a monolithic structure prior to application of the multilayer coating, such as with a woven fabric that comprises a plurality of woven fibers. The method of the invention may also be conducted on a plurality of fibers that are arranged as a fiber web or other arrangement, which are not technically considered to be a fabric at the time of coating, and is described herein as coating on a plurality of fibrous substrates. The invention also provides fabrics formed from a plurality of coated fibers and articles formed from said fabrics.

The fibrous substrates of the invention are coated with a multilayer coating that comprises at least two different polymer layers, wherein at least one of the layers is formed from a fluorine-containing polymer. As used herein, a "fluorine-containing" polymeric binder describes a material formed from at least one polymer that includes fluorine atoms. Such include fluoropolymers and/or fluorocarbon-containing materials, i.e. fluorocarbon resins. A "fluorocarbon resin" generally refers to polymers including fluorocarbon groups.

The multilayer coatings comprise a first polymer layer on a surface of the fibers, said first polymer layer comprising a first polymer, and a second polymer layer on the first polymer layer, said second polymer layer comprising a second polymer, wherein the first polymer and the second polymer are different and wherein at least one of the first polymer and the second polymer comprises a fluorine-containing polymer.

For the purposes of the invention, articles that have superior ballistic penetration resistance describe those which exhibit excellent properties against high speed projectiles. The articles also exhibit excellent resistance properties against fragment penetration, such as shrapnel. For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As stated above, the multilayer coatings may be applied onto a single polymeric fiber or a plurality of polymeric fibers. A plurality of fibers may be present in the form of a fiber web, a woven fabric, a non-woven fabric or a yarn, where a yarn is defined herein as a strand consisting of multiple fibers and where a fabric comprises a plurality of united fibers. In embodiments including a plurality of fibers, the multilayer coatings may be applied either before the fibers are arranged into a fabric or yarn, or after the fibers are arranged into a fabric or yarn.

The fibers of the invention may comprise any polymeric fiber type. Most preferably, the fibers comprise high strength, high tensile modulus fibers which are useful for the formation of ballistic resistant materials and articles. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

The polymers forming the fibers are preferably high-strength, high tensile modulus fibers suitable for the manufacture of ballistic resistant fabrics. Particularly suitable high-strength, high tensile modulus fiber materials that are particularly suitable for the formation of ballistic resistant materials and articles include polyolefin fibers including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, liquid crystal copolyester fibers and rigid rod fibers such as M5® fibers. Each of these fiber types is conventionally known in the art. Also suitable for producing polymeric fibers are copolymers, block polymers and blends of the above materials.

The most preferred fiber types for ballistic resistant fabrics include polyethylene, particularly extended chain polyethylene fibers, aramid fibers, polybenzazole fibers, liquid crystal copolyester fibers, polypropylene fibers, particularly highly oriented extended chain polypropylene fibers, polyvinyl alcohol fibers, polyacrylonitrile fibers and rigid rod fibers, particularly M5® fibers.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. Nos. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,623,547 and 4,748,064.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by Dupont corporation under the trademark of KEVLAR®. Also useful in the practice of this invention are poly(m-phenylene isophthalamide) fibers produced commercially by Dupont under the trademark NOMEX® and fibers produced commercially by Teijin under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Preferred polybenzazole fibers are ZYLON® brand fibers from Toyobo Co. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

The other suitable fiber types for use in the present invention include rigid rod fibers such as M5® fibers, and combinations of all the above materials, all of which are commercially available. For example, the fibrous layers may be formed from a combination of SPECTRA® fibers and Kevlar® fibers. M5® fibers are formed from pyridobisimidazole-2,6-diyl (2,5-dihydroxy-p-phenylene) and are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene SPECTRA® fibers, aramid Kevlar® fibers and aramid TWARON® fibers. The fibers may be of any suitable denier, such as, for example, 50 to about 3000 denier, more preferably from about 200 to 3000 denier, still more preferably from about 650 to about 2000 denier, and most preferably from about 800 to about 1500 denier. The selection is governed by considerations of ballistic effectiveness and cost. Finer fibers are more costly to manufacture and to weave, but can produce greater ballistic effectiveness per unit weight.

The most preferred fibers for the purposes of the invention are either high-strength, high tensile modulus extended chain polyethylene fibers or high-strength, high tensile modulus para-aramid fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more.

These combined high strength properties are obtainable by employing well known processes. U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. Such methods, including solution grown or gel fiber processes, are well known in the art. Methods of forming each of the other preferred fiber types, including para-aramid fibers, are also conventionally known in the art, and the fibers are commercially available.

In accordance with the invention, a multilayer coating is applied onto at least part of a surface of the fiber or fabric substrates described herein. The multilayer coating comprises a first polymer layer directly on a surface of said fibers, and a second polymer layer on said first polymer layer, wherein the first polymer layer and the second polymer layer are different. One or both of the first polymer and/or second polymer may function as a binder material that binds a plurality of fibers together by way of their adhesive characteristics or after being subjected to well known heat and/or pressure conditions. In accordance with the invention, at least one of the first polymer layer and the second polymer layer comprises a fluorine-containing polymer. While both the first polymer layer and the second polymer layer may comprise different fluorine-containing polymers, it is most preferred that only one of said layers comprises a fluorine-containing polymer, while the other is substantially absent of fluorine. In the most preferred embodiment of the invention, the first polymer layer comprises a fluorine-containing polymer and the second polymer layer is substantially absent of fluorine. Additional polymer layers may also be coated onto the fibers, where each additional polymer layer is preferably coated onto the last applied polymer layer. The optional additional polymer layers may be the same as or different than the first polymer layer and/or the second polymer layer.

It has been found that polymers containing fluorine atoms, particularly fluoropolymers and/or a fluorocarbon resins, are desirable because of their resistance to dissolution, permeation and/or transpiration by water and resistance to dissolution, permeation and/or transpiration by one or more organic solvents. Importantly, when fluorine-containing polymers are applied onto ballistic resistant fibers together with another polymeric material that is conventionally used in the art of ballistic resistant fabrics as a polymeric matrix material, the ballistic performance of a ballistic resistant composite formed therefrom is substantially retained after the composite is immersed in either water, e.g. salt water, or gasoline.

More specifically, it has been found that fabrics including fibers coated with a layer of a fluorine-containing polymer and a separately applied layer of a conventional matrix polymer have a significantly improved $V_{50}$ retention % after immersion in either salt water or gasoline, i.e. greater than 90% retention as illustrated in the inventive examples, compared to fabrics formed with only non-fluorine-containing polymeric materials. Such materials also have a significantly reduced tendency to absorb either salt water or gasoline compared to fabrics formed without a fluorine-containing polymer layer, as the fluorine-containing polymer serves as a barrier between individual filaments, fibers and/or fabrics and salt water or gasoline.

Fluorine-containing materials, particularly fluoropolymers and fluorocarbon resin materials, are commonly known for their excellent chemical resistance and moisture barrier properties. Useful fluoropolymer and fluorocarbon resin materials herein include fluoropolymer homopolymers, fluoropolymer copolymers or blends thereof as are well known in the art and are described in, for example, U.S. Pat. Nos. 4,510,301, 4,544,721 and 5,139,878. Examples of useful fluoropolymers include, but are not limited to, homopolymers and copolymers of chlorotrifluoroethylene, ethylene-chlorotrifluoroethylene copolymers, ethylene-tetrafluoroethylene copolymers, fluorinated ethylene-propylene copolymers, perfluoroalkoxyethylene, polychlorotrifluoroethylene, polytetrafluoroethylene, polyvinyl fluoride, polyvinylidene fluoride, and copolymers and blends thereof.

As used herein, copolymers include polymers having two or more monomer components. Preferred fluoropolymers include homopolymers and copolymers of polychlorotrifluoroethylene. Particularly preferred are polychlorotrifluoroethylene (PCTFE) homopolymer materials sold under the ACLON™ trademark and which are commercially available from Honeywell International Inc. of Morristown, New Jersey. The most preferred fluoropolymers or fluorocarbon resins include fluorocarbon-modified polymers, particularly fluoro-oligomers and fluoropolymers formed by grafting fluorocarbon side-chains onto conventional polyethers (i.e. fluorocarbon-modified polyethers), polyesters (i.e. fluorocarbon-modified polyesters), polyanions (i.e. fluorocarbon-modified polyanions) such as polyacrylic acid (i.e. fluorocarbon-modified polyacrylic acid) or polyacrylates (i.e. fluorocarbon-modified polyacrylates), and polyurethanes (i.e. fluorocarbon-modified polyurethanes). These fluorocarbon side chains or perfluoro compounds are generally produced by a telomerization process and are referred to as $C_8$ fluorocarbons. For example, a fluoropolymer or fluorocarbon resin may be derived from the telomerization of an unsaturated fluoro-compound, forming a fluorotelomer, where said fluorotelomer is further modified to allow reaction with a polyether, polyester, polyanion, polyacrylic acid, polyacrylate or polyurethane, and where the fluorotelomer is then grafted onto a polyether, polyester, polyanion, polyacrylic acid, polyacrylate or polyurethane. Good representative examples of these fluorocarbon-containing polymers are NUVA® fluoropolymer products, commercially available from Clariant International, Ltd. of Switzerland. Other fluorocarbon resins, fluoro-oligomers and fluoropolymers having perfluoro acid-based and perfluoro alcohol-based side chains are also most preferred. Fluoropolymers and fluorocarbon resins having fluorocarbon side chains of shorter lengths, such as $C_6$, $C_4$ or $C_2$, are also suitable, such as POLYFOX™ fluorochemicals, commercially available from Omnova Solutions, Inc. of Fairlawn, Ohio.

The fluorine-containing polymeric material may also comprise a combination of a fluoropolymer or a fluorocarbon-containing material with another polymer, including blends of fluorine-containing polymeric materials with conventional polymeric binder (matrix) materials such as those described herein. In one preferred embodiment, the polymer layer comprising a fluorine-containing polymer is a blend of a fluorine-containing polymer and an acrylic polymer. Preferred acrylic polymers non-exclusively include acrylic acid esters, particularly acrylic acid esters derived from monomers such as methyl acrylate, ethyl acrylate, n-propyl acrylate, 2-propyl acrylate, n-butyl acrylate, 2-butyl acrylate and tert-butyl acrylate, hexyl acrylate, octyl acrylate and 2-ethylhexyl acrylate. Preferred acrylic polymers also particularly include methacrylic acid esters derived from monomers such as methyl methacrylate, ethyl methacrylate, n-propyl methacrylate, 2-propyl methacrylate, n-butyl methacrylate, 2-butyl methacrylate, tert-butyl methacrylate, hexyl methacrylate, octyl methacrylate and 2-ethylhexyl methacrylate. Copolymers and terpolymers made from any of these constituent monomers are also preferred, along with those also incorporating acrylamide, n-methylol acrylamide, acrylonitrile, methacrylonitrile, acrylic acid and maleic anhydride. Also suitable are modified acrylic polymers modified with non-acrylic monomers. For example, acrylic copolymers and acrylic terpolymers incorporating suitable vinyl monomers such as: (a) olefins, including ethylene, propylene and isobutylene; (b) styrene, N-vinylpyrrolidone and vinylpyridine; (c) vinyl ethers, including vinyl methyl ether, vinyl ethyl ether and vinyl n-butyl ether; (d) vinyl esters of aliphatic carboxylic acids, including vinyl acetate, vinyl propionate, vinyl butyrate, vinyl laurate and vinyl decanoates; and (f) vinyl halides, including vinyl chloride, vinylidene chloride, ethylene dichloride and propenyl chloride. Vinyl monomers which are likewise suitable are maleic acid diesters and fumaric acid diesters, in particular of monohydric alkanols having 2 to 10 carbon atoms, preferably 3 to 8 carbon atoms, including dibutyl maleate, dihexyl maleate, dioctyl maleate, dibutyl fumarate, dihexyl fumarate and dioctyl fumarate.

Acrylic polymers and copolymers are preferred because of their inherent hydrolytic stability, which is due to the straight carbon backbone of these polymers. Acrylic polymers are also preferred because of the wide range of physical properties available in commercially produced materials. The range of physical properties available in acrylic resins matches, and perhaps exceeds, the range of physical properties thought to be desirable in polymeric binder materials of ballistic resistant composite matrix resins.

One of the first polymer layer or the second polymer layer preferably comprises a non-fluorine containing, i.e. substantially absent of fluorine, polymeric material that is conventionally employed in the art of ballistic resistant fabrics as a polymeric binder (matrix) material. Most preferably, the second polymer layer is formed from a non-fluorine-containing polymeric material. A wide variety of conventional, non-fluorine-containing polymeric binder materials are known in the art. Such include both low modulus, elastomeric materials and high modulus, rigid materials. Preferred low modulus, elastomeric materials are those having an initial tensile modulus less than about 6,000 psi (41.3 MPa), and preferred high modulus, rigid materials are those having an initial tensile modulus at least about 100,000 psi (689.5 MPa), each as measured at 37° C. by ASTM D638. As used herein throughout, the term tensile modulus means the modulus of elasticity as measured by ASTM 2256 for a fiber and by ASTM D638 for a polymeric binder material.

An elastomeric polymeric binder material may comprise a variety of materials. A preferred elastomeric binder material comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably about 0° C. or less, more preferably about −40° C. or less, and most preferably about −50° C. or less. The elastomer also has a preferred elongation to break of at least about 50%, more preferably at least about 100% and most preferably has an elongation to break of at least about 300%.

A wide variety of materials and formulations having a low modulus may be utilized as a non-fluorine-containing polymeric binder material. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, silicone elastomers, copolymers of ethylene, and combinations thereof, and other low modulus polymers and copolymers. Also preferred are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type $R-(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred low modulus polymeric binder materials comprise styrenic block copolymers, particularly polystyrene-polyisoprene-polystyrene-block copolymers, sold under the trademark KRATON® commercially produced by Kraton Polymers and HYCAR® T122 acrylic resins commercially available from Noveon, Inc. of Cleveland, Ohio.

Preferred high modulus, rigid polymers useful as the other, preferably non-fluorine-containing polymeric binder material include materials such as a vinyl ester polymer or a styrene-butadiene block copolymer, and also mixtures of polymers such as vinyl ester and diallyl phthalate or phenol formaldehyde and polyvinyl butyral. A particularly preferred high modulus material is a thermosetting polymer, preferably soluble in carbon-carbon saturated solvents such as methyl ethyl ketone, and possessing a high tensile modulus when cured of at least about $1\times10^5$ psi (689.5 MPa) as measured by ASTM D638. Particularly preferred rigid materials are those described in U.S. Pat. No. 6,642,159, which is incorporated herein by reference.

In the preferred embodiments of the invention, either the first polymer layer or the second polymer layer, most preferably the second polymer layer, comprises a polyurethane polymer, a polyether polymer, a polyester polymer, a polycarbonate resin, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene/butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy resin, a novolac resin, a phenolic resin, a vinyl ester resin, a silicone resin, a nitrile rubber polymer, a natural rubber polymer, a cellulose acetate butyrate polymer, a polyvinyl butyral polymer, an acrylic polymer, an acrylic copolymer or an acrylic copolymer incorporating non-acrylic monomers.

The rigidity, impact and ballistic properties of the articles formed from the fibrous composites of the invention are affected by the tensile modulus of the binder polymers coating the fibers. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without one or more coatings of a polymeric binder material. However, low tensile modulus polymeric binder polymers also yield lower rigidity composites. Further, in certain applications, particularly those where a composite must function in both anti-ballistic and structural modes, there is needed a superior combination of ballistic resistance and rigidity. Accordingly, the most appropriate type of non-fluorine-containing polymeric binder material to be used will vary depending on the type of article to be formed from the fabrics of the invention. In order to achieve a compromise in both properties, a suitable non-fluorine containing material may combine both low modulus and high modulus materials to form a single polymeric binder material for use as the first polymer layer, as the second polymer layer or as any additional polymer layer. Each polymer layer may also include fillers such as carbon black or silica, may be extended with oils, or may be vulcanized by sulfur, peroxide, metal oxide or radiation cure systems if appropriate, as is well known in the art.

The application of the multilayer coating is conducted prior to consolidating multiple fiber plies, and the multilayer coating is to be applied on top of any pre-existing fiber finish, such as a spin finish. The fibers of the invention may be coated on, impregnated with, embedded in, or otherwise applied with each polymer layer by applying each layer to the fibers, followed by consolidating the coated fiber layers to form a composite. The individual fibers are coated either sequentially or consecutively. Each polymer layer is preferably first applied onto a plurality of fibers followed by forming either a woven fabric or at least one non-woven fiber ply from said fibers. In a preferred embodiment, a plurality of individual fibers are provided as a fiber web, wherein a first polymer layer is applied onto the fiber web, and thereafter a second polymer layer is applied onto the first polymer layer on the fiber web. Thereafter, the coated fiber web is preferably formed into a fabric.

Alternately, a plurality of fibers may first be arranged into a fabric and subsequently coated, or at least one non-woven fiber ply may be formed first followed by applying each polymer layer onto each fiber ply. In another embodiment, the fibrous substrate is a woven fabric wherein uncoated fibers are first woven into a woven fabric, which fabric is subsequently coated with each polymer layer. It should be understood that the invention also encompasses other methods of producing fibrous substrates having the multilayer coatings described herein. For example, a plurality of fibers may first be coated with a first polymer layer, followed by forming a woven or non-woven fabric from said fibers, and subsequently applying a second polymer layer onto the first polymer layer on the woven or non-woven fabric. In the most preferred embodiment of the invention, the fibers of the invention are first coated with each polymeric binder material, followed by arranging a plurality of fibers into either a woven or non-woven fabric. Such techniques are well known in the art.

For the purposes of the present invention, the term "coated" is not intended to limit the method by which the polymer layers are applied onto the fibrous substrate surface. Any appropriate method of applying the polymer layers onto substrates may be utilized where the first polymer layer is applied first, followed by subsequently applying the second polymer layer onto the first polymer layer. For example, the polymer layers may be applied in solution form by spraying or roll coating a solution of the polymeric material onto fiber surfaces, wherein a portion of the solution comprises the desired polymer or polymers and a portion of the solution comprises a solvent capable of dissolving the polymer or polymers, followed by drying. Another method is to apply a neat polymer of each coating material to fibers either as a liquid, a sticky solid or particles in suspension or as a fluidized bed. Alternatively, each coating may be applied as a solution, emulsion or dispersion in a suitable solvent which does not adversely affect the properties of fibers at the temperature of application. For example, the fibrous substrate can be transported through a solution of the polymeric binder material to substantially coat the substrate with a first polymeric material and then dried to form a coated fibrous substrate, followed by similarly coating with a second different polymeric material. The resulting multilayer coated fiber is then arranged into the desired configuration. In another coating technique, fiber plies or woven fabrics may first be arranged, followed by dipping the plies or fabrics into a bath of a solution containing the first polymeric binder material dissolved in a suitable solvent, such that each individual fiber is at least partially coated with the polymeric binder material, and then dried through evaporation or volatilization of the solvent, and subsequently the second polymer layer may be applied via the same method. The dipping procedure may be repeated several times as required to place a desired amount of polymeric material onto the fibers, preferably encapsulating each of the individual fibers or covering all or substantially all of the fiber surface area with the polymeric material.

Other techniques for applying the coating to the fibers may be used, including coating of the high modulus precursor (gel fiber) before the fibers are subjected to a high temperature stretching operation, either before or after removal of the solvent from the fiber (if using a gel-spinning fiber forming technique). The fiber may then be stretched at elevated temperatures to produce the coated fibers. The gel fiber may be passed through a solution of the appropriate coating polymer under conditions to attain the desired coating. Crystallization of the high molecular weight polymer in the gel fiber may or may not have taken place before the fiber passes into the solution. Alternatively, the fibers may be extruded into a fluidized bed of an appropriate polymeric powder. Furthermore, if a stretching operation or other manipulative process, e.g. solvent exchanging, drying or the like is conducted, the coating may be applied to a precursor material of the final fibers. Additionally, the first polymer layer and the second polymer layer may be applied using two different methods.

Preferably, the first and second polymer layers are each applied to the fibrous substrate surfaces when the polymers forming said layers are wet, i.e. in the liquid state. Most preferably, the first polymer and the second polymer are contacted with each other as liquids. In other words, the second polymer is preferably applied onto the fibrous substrate as a liquid while the first polymer is wet. Wet application is preferred because at least one of the first polymer layer or the second polymer layer is formed from a fluorine-containing polymer, which are commonly difficult to attach to layers formed from non-fluorine-containing polymers. The wet application of each polymer facilitates interlayer adhesion of the different polymer layers, wherein the individual layers are unified at the surfaces where they contact each other as polymer molecules from the polymer layers commingle with each other at their contact surfaces and at least partially fuse together. For the purposes of the invention, a liquid polymer includes polymers that are combined with a solvent or other liquid capable of dissolving or dispersing a polymer, as well as molten polymers that are not combined with a solvent or other liquid.

While any liquid capable of dissolving or dispersing a polymer may be used, preferred groups of solvents include water, paraffin oils and aromatic solvents or hydrocarbon solvents, with illustrative specific solvents including paraffin oil, xylene, toluene, octane, cyclohexane, methyl ethyl ketone (MEK) and acetone. The techniques used to dissolve or disperse the coating polymers in the solvents will be those conventionally used for the coating of similar materials on a variety of substrates.

It is known that fluorine-containing polymer layers can be difficult to adhere to non-fluorine-containing polymer layers. In general, fluorine-containing solid surfaces are difficult to wet or adhere with a non-fluorine containing liquid. This can be an issue when attempting to coat fibers that are already coated with a fluorine-containing finish with a conventional liquid matrix resin. In other arts, it is known to use special intermediate adhesive tie layers to attach the dissimilar layers, but such adhesive tie layers are undesirable for use in ballistic resistant composites as they may detrimentally affect the properties of the composites. However, it has been found that multiple layers of dissimilar polymeric matrix materials may be applied onto fibers without using an adhesive tie layer. Particularly, it has been found that wet fluorine-containing liquids and wet non-fluorine-containing liquids are miscible and will wet each other when they are brought together. Accordingly, such wet dissimilar materials may be applied onto a fiber surface and be effectively adhered to each other and to the surface of a fibrous substrate.

In a most preferred method that has been found to be effective, the first polymer layer and the second polymer layer are first applied onto separate substrates, followed by bringing the substrates together to contact the polymer layers with each other. Most preferably, this method comprises: applying the first polymer onto a surface of a fibrous substrate; applying the second polymer onto a surface of a support; thereafter, joining the fibrous substrate and the support to contact the first polymer with the second polymer; and then separating the support from the fibrous substrate, such that at least a portion of the second polymer is transferred from the support onto the first polymer. The support may be any solid substrate that is capable of supporting a polymer layer, such as a silicone-coated release liner, a solid film or another fabric. The support may also comprise a conveyor belt that is an integral part of utilized fabric processing equipment. The support must be capable of transferring at least a portion of the second polymer onto the first polymer. This method is especially attractive for the application of layers of dissimilar polymeric materials onto fibrous substrates without regard to chemical or physical incompatibilities of the dissimilar polymeric materials. A preferred method for conducting this technique is described in the examples below and illustrated in FIG. 1.

Generally, a polymeric binder coating is necessary to efficiently merge, i.e. consolidate, a plurality of fiber plies. The multilayer matrix coating may be applied onto the entire surface area of the fibers, or only onto a partial surface area of the fibers. Most preferably, the multilayer matrix coating is applied onto substantially all the surface area of each component fiber of a woven or non-woven fabric of the invention. Where the fabrics comprise a plurality of yarns, each fiber forming a single strand of yarn is preferably coated with the multilayer polymeric binder coating.

When the fibrous substrate is an individual fiber, a plurality of individual fibers may be coated with the multilayer coating either sequentially or consecutively, and thereafter may be organized into one or more non-woven fiber plies, a non-woven fabric, or woven into a fabric. With regard to woven fabrics, while the matrix coatings may be applied either before or after the fibers are woven, it is most preferred that the matrix coatings be applied after fibers are woven into a fabric due to potential processing limitations. With regard to non-woven fabrics, it is preferred that the polymer coatings be applied before the fibers are formed into a non-woven fabric.

The fibers may be formed into non-woven fabrics which comprise a plurality of overlapping, non-woven fibrous plies that are consolidated into a single-layer, monolithic element. In this embodiment, each ply comprises an arrangement of non-overlapping fibers that are aligned in a unidirectional, substantially parallel array. This type of fiber arrangement is known in the art as a "unitape" (unidirectional tape) and is referred to herein as a "single ply". As used herein, an "array" describes an orderly arrangement of fibers or yarns, and a "parallel array" describes an orderly parallel arrangement of fibers or yarns. A fiber "layer" describes a planar arrangement of woven or non-woven fibers or yarns including one or more plies. As used herein, a "single-layer" structure refers to monolithic structure composed of one or more individual fiber plies that have been consolidated into a single unitary structure. By "consolidating" it is meant that the multilayer polymeric binder coating together with each fiber ply are combined into a single unitary layer. Consolidation can occur via drying, cooling, heating, pressure or a combination thereof. Heat and/or pressure may not be necessary, as the fibers or fabric layers may just be glued together, as is the case in a wet lamination process. The term "composite" refers to combinations of fibers with the multilayer polymeric binder material. Such is conventionally known in the art.

A preferred non-woven fabric of the invention includes a plurality of stacked, overlapping fiber plies (plurality of unitapes) wherein the parallel fibers of each single ply (unitape) are positioned orthogonally (0°/90°) to the parallel fibers of each adjacent single ply relative to the longitudinal fiber direction of each single ply. The stack of overlapping non-woven fiber plies is consolidated under heat and pressure, or by adhering the polymeric resin coatings of individual fiber plies, to form a single-layer, monolithic element which has also been referred to in the art as a single-layer, consolidated network where a "consolidated network" describes a consolidated (merged) combination of fiber plies with a polymeric binder material. The terms "polymeric binder" and "polymeric matrix" are used interchangeably herein, and describe a material that binds fibers together. These terms are conventionally known in the art, and refer to a multilayer material herein.

As is conventionally known in the art, excellent ballistic resistance is achieved when individual fiber plies are cross-plied such that the fiber alignment direction of one ply is rotated at an angle with respect to the fiber alignment direction of another ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,573; and 4,737,402.

Most typically, non-woven fabrics include from 1 to about 6 plies, but may include as many as about 10 to about 20 plies as may be desired for various applications. The greater the number of plies translates into greater ballistic resistance, but also greater weight. Accordingly, the number of fiber plies forming a fabric or an article of the invention varies depending upon the ultimate use of the fabric or article. For example, in body armor vests for military applications, in order to form an article composite that achieves a desired 1.0 pound per square foot areal density (4.9 kg/m$^2$), a total of at 22 individual plies may be required, wherein the plies may be woven, knitted, felted or non-woven fabrics (with parallel oriented fibers or other arrangements) formed from the high-strength fibers described herein. In another embodiment, body armor vests for law enforcement use may have a number of plies based on the National Institute of Justice (NIJ) Threat Level. For example, for an NIJ Threat Level IIIA vest, there may also be a total of 22 plies. For a lower NIJ Threat Level, fewer plies may be employed.

Further, the fiber plies of the invention may alternately comprise yarns rather than fibers, where a "yarn" is a strand consisting of multiple fibers or filaments. Non-woven fiber plies may alternately comprise other fiber arrangements, such as felted structures which are formed using conventionally known techniques, comprising fibers in random orientation instead of parallel arrays. Articles of the invention may also comprise combinations of woven fabrics, non-woven fabrics formed from unidirectional fiber plies and non-woven felt fabrics.

Consolidated non-woven fabrics may be constructed using well known methods, such as by the methods described in U.S. Pat. No. 6,642,159, the disclosure of which is incorporated herein by reference. As is well known in the art, consolidation is done by positioning the individual fiber plies on one another under conditions of sufficient heat and pressure to cause the plies to combine into a unitary fabric. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the polymeric binder coatings can be caused to stick or flow without completely melting. However, generally, if the polymeric binder materials are caused to melt, relatively little pressure is required to form the composite, while if the binder materials are only heated to a sticking point, more pressure is typically required. As is conventionally known in the art, consolidation may be conducted in a calender set, a flat-bed laminator, a press or in an autoclave.

Alternately, consolidation may be achieved by molding under heat and pressure in a suitable molding apparatus. Generally, molding is conducted at a pressure of from about 50 psi (344.7 kPa) to about 5000 psi (34470 kPa), more preferably about 100 psi (689.5 kPa) to about 1500 psi (10340 kPa), most preferably from about 150 psi (1034 kPa) to about 1000 psi (6895 kPa). Molding may alternately be conducted at higher pressures of from about 500 psi (3447 kPa) to about 5000 psi, more preferably from about 750 psi (5171 kPa) to about 5000 psi and more preferably from about 1000 psi to about 5000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. (~149° C.) and most preferably at a temperature from about 200° F. to about 280° F. (~121° C.). The pressure under which the fabrics of the invention are molded has a direct effect on the stiffness or flexibility of the resulting molded product. Particularly, the higher the pressure at which the fabrics are molded, the higher the stiffness, and vice-versa. In addition to the molding pressure, the quantity, thickness and composition of the fabric plies and polymeric binder coating types also directly affects the stiffness of the articles formed from the inventive fabrics.

While each of the molding and consolidation techniques described herein are similar, each process is different. Particularly, molding is a batch process and consolidation is a continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft body armor fabrics. Molding is typically reserved for the manufacture of hard armor, e.g. rigid plates. In the context of the present invention, consolidation techniques and the formation of soft body armor are preferred.

In either process, suitable temperatures, pressures and times are generally dependent on the type of polymeric binder coating materials, polymeric binder content (of the combined coatings), process used and fiber type. The fabrics of the invention may optionally be calendered under heat and pressure to smooth or polish their surfaces. Calendering methods are well known in the art.

Woven fabrics may be formed using techniques that are well known in the art using any fabric weave, such as plain weave, crowfoot weave, basket weave, satin weave, twill weave and the like. Plain weave is most common, where fibers are woven together in an orthogonal 0°/90° orientation. In another embodiment, a hybrid structure may be assembled where one both woven and non-woven fabrics are combined and interconnected, such as by consolidation. Prior to weaving, the individual fibers of each woven fabric material may or may not be coated with the first polymer layer and second polymer layer, or other additional polymer layers.

To produce a fabric article having sufficient ballistic resistance properties, the proportion of fibers forming the fabric preferably comprises from about 50% to about 98% by weight of the fibers plus the weight of the combined polymeric coatings, more preferably from about 70% to about 95%, and most preferably from about 78% to about 90% by weight of the fibers plus the polymeric coatings. Thus, the total weight of the combined polymeric coatings preferably comprises from about 2% to about 50% by weight of the fabric, more preferably from about 5% to about 30% and most preferably from about 10% to about 22% by weight of the fabric, wherein 16% is most preferred.

The thickness of the individual fabrics will correspond to the thickness of the individual fibers. A preferred woven fabric will have a preferred thickness of from about 25 μm to about 500 μm per layer, more preferably from about 50 μm to about 385 μm and most preferably from about 75 μm to about 255 μm per layer. A preferred non-woven fabric, i.e. a non-woven, single-layer, consolidated network, will have a preferred thickness of from about 12 μm to about 500 μm, more preferably from about 50 μm to about 385 μm and most preferably from about 75 μm to about 255 μm, wherein a single-layer, consolidated network typically includes two consolidated plies (i.e. two unitapes). While such thicknesses are preferred, it is to be understood that other thicknesses may be produced to satisfy a particular need and yet fall within the scope of the present invention.

The fabrics of the invention will have a preferred areal density of from about 50 grams/$m^2$ (gsm) (0.01 lb/$ft^2$ (psf)) to about 1000 gsm (0.2 psf). More preferable areal densities for the fabrics of this invention will range from about 70 gsm (0.014 psf) to about 500 gsm (0.1 psf). The most preferred areal density for fabrics of this invention will range from about 100 gsm (0.02 psf) to about 250 gsm (0.05 psf). The articles of the invention, which comprise multiple individual layers of fabric stacked one upon the other, will further have a preferred areal density of from about 1000 gsm (0.2 psf) to about 40,000 gsm (8.0 psf), more preferably from about 2000 gsm (0.40 psf) to about 30,000 gsm (6.0 psf), more preferably from about 3000 gsm (0.60 psf) to about 20,000 gsm (4.0 psf), and most preferably from about 3750 gsm (0.75 psf) to about 10,000 gsm (2.0 psf).

The composites of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758. The composites are particularly useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devises encountered in a military and peace keeping missions. As used herein, "soft" or "flexible" armor is armor that does not retain its shape when subjected to a significant amount of stress and is incapable of being free-standing without collapsing. The composites are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. Fabric composites can be cut into a plurality of discrete sheets and stacked for formation into an article or they can be formed into a precursor which is subsequently used to form an article. Such techniques are well known in the art.

Garments may be formed from the composites of the invention through methods conventionally known in the art. Preferably, a garment may be formed by adjoining the ballistic resistant fabric composites of the invention with an article of clothing. For example, a vest may comprise a generic fabric vest that is adjoined with the ballistic resistant composites of the invention, whereby the inventive composites are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as un-attached coupling or juxtaposition with another fabric, such that the ballistic resistant materials may optionally be easily removable from the vest or other article of clothing. Articles used in forming flexible structures like flexible sheets, vests and other garments are preferably formed from using a low tensile modulus binder material for the non-fluorine-containing polymer layer. Hard articles like helmets and armor are preferably formed using a high tensile modulus binder material for the non-fluorine-containing polymer layer.

Ballistic resistance properties are determined using standard testing procedures that are well known in the art. Particularly, the protective power or penetration resistance of a ballistic resistant composite is normally expressed by citing the impacting velocity at which 50% of the projectiles penetrate the composite while 50% are stopped by the shield, also known as the $V_{50}$ value. As used herein, the "penetration resistance" of an article is the resistance to penetration by a designated threat, such as physical objects including bullets, fragments, shrapnel and the like, and non-physical objects, such as a blast from explosion. For composites of equal areal density, which is the weight of the composite divided by its area, the higher the $V_{50}$, the better the ballistic resistance of the composite. The ballistic resistant properties of the articles of the invention will vary depending on many factors, particularly the type of fibers used to manufacture the fabrics, the percent by weight of the fibers in the composite, the suitability of the physical properties of the matrix materials, the number of layers of fabric making up the composite and the total areal density of the composite. However, the use of one or more polymeric coatings that are resistant to dissolution or penetration by sea water, and resistant to dissolution or penetration by one or more organic solvents, does not negatively affect the ballistic properties of the articles of the invention.

The following examples serve to illustrate the invention:

EXAMPLE 1

A silicone-coated release paper support was coated with a polymeric binder material that was a water-based acrylic dispersion of HYCAR® T122 (commercially available from Noveon, Inc. of Cleveland, Ohio) using a standard pan-fed reverse roll coating method. The polymeric binder material was applied at full strength.

Separately, a fibrous web comprising aramid yarns (TWARON® 1000-denier, type 2000 aramid yarns, commercially available from Teijin Twaron BV of The Netherlands) was coated with a dilute water-based dispersion of a fluorine-containing resin (NUVA® LB, commercially available from Clariant International, Ltd. of Switzerland; dilution: 10% of Nuva LB, 90% de-ionized water) in a yarn impregnator using a dip and squeeze technique.

A schematic illustration of this hybrid coating technique is provided in FIG. 1. In the pan-fed reverse roll coating method, a metering roller and an application roller were positioned in parallel at a pre-determined fixed distance from each other. Each roller has approximately the same physical dimensions. The rollers were held at the same elevation and their bottoms were submerged in a liquid resin bath of the polymeric binder material contained in a pan. The metering roller was held stationary while the applicator roller rotated in a direction that would lift some of the liquid in the resin bath towards the gap between the rollers. Only the amount of liquid that will fit through this gap is carried to the upper surface of the applicator roll, and any excess falls back into the resin bath.

Concurrently, the support was carried towards the upper surface of the applicator roll, with its direction of travel being opposite to the direction the upper surface of the rotating applicator roll. When the support was directly above the applicator roll, it was pressed onto the upper surface of the applicator roller by means of a backing roller. All of the liquid that was carried by the upper surface of the applicator roller was then transferred to the support. This technique was used to apply a precisely metered amount of liquid resin to the surface of the silicone-coated release paper.

The dip and squeeze technique was conducted to coat the fibrous web with the diluted resin dispersion using the following steps:

1. Spools of TWARON® yarn were unwound from a creel.
2. The yarns were sent through a though a series of combs, which caused the yarns to be evenly spaced and parallel to each other. At this point, the individual yarns were closely positioned and parallel to one another in a substantially parallel array.
3. The substantially parallel array was then passed over a series of rotating idler rollers that redirected the substantially parallel array down and through the liquid resin bath. In this bath, each of the yarns were completely submerged into the liquid for a length of time sufficient to cause the liquid to penetrate each yarn bundle, wetting the individual fibers or filaments within the yarn.
4. At the end of this liquid resin bath, the wetted fibrous web was pulled over a series of stationary (non-rotating) spreader bars. The spreader bars spread out the individual yarns until they abutted or overlapped with their neighbors. Before spreading, the cross-sectional shape of each yarn bundle was approximately round. After spreading, the cross-sectional shape of each yarn bundle was approximately elliptical, tending towards a rectangle shape. An ultimate spread would be for each fiber or filament to be next to one another in a single fiber plane.
5. Once the wetted fibrous web passed over the last spreader bar, it was again re-directed, this time up and out of the liquid. This wetted fibrous web then was wrapped around a large rotating idler roller. The fibrous web carried with it an excess of the liquid.
6. In order to remove this excess liquid from the fibrous web, another freely rotating idler roller was positioned to ride on the surface of the large rotating idler roller. These two idler rollers were parallel to each other and the freely rotating idler roller was mounted in such a way that it beared down on the large rotating idler roller in a radial direction, effectively forming a nip. The wetted fibrous web was carried through this nip and the force applied by the freely rotating idler roller acted to squeeze off the excess liquid, which ran back into the liquid resin bath.

At this point, the coated fibrous web and the coated silicone-coated release paper are brought into contact with one another on the "combining roller". The wetted (impregnated) fibrous web is cast onto the wet side of the silicone-coated release paper and passed over the combining roller such that the NUVA® LB-coated aramid fiber web is pressed into the wet coating of HYCAR® T122 that was carried on the surface of the silicone-coated release paper. The coating of HYCAR® T122 appeared to penetrate or extrude through the saturated aramid fiber web, without disrupting the good spread of the fiber web. The assembly was then passed through an oven to dry off the water.

A series of squares were cut from this unidirectional tape ("UDT"). Two squares were then oriented fiber-side to fiber-side and one of the squares was rotated so that the direction of its fibers was perpendicular to the fiber direction of the first square. These pairs of configured squares were then placed into a press, and subjected to 240° F. (115.56° C.) and 100 PSI (689.5 kPa) for 15 minutes. The press was then cooled to room temperature and the pressure was released. The squares were now bonded to one another. The release paper was removed from both sides of this composite, resulting in a single layer of a non-woven fabric. This procedure was repeated to produce additional layers as needed for ballistic testing.

Overall, a roll of UDT made using this hybrid coating technique was of very good quality. The yarn spread was good, the amount of resin added to the fibrous web was very consistent and the UDT was anchored down to the silicone-coated release paper well enough to allow further processing.

EXAMPLE 2 (COMPARATIVE)

Using the same machine setup as in Example 1, another UDT roll of TWARON® 1000-denier, type 2000 aramid yarns was formed. In this example, the dilute dispersion in the yarn impregnator was replaced with de-ionized water and the amount of the HYCAR® T122 acrylic resin that was coated onto the silicone-coated release paper was increased by about 20%. The de-ionized water in the yarn impregnator aided the aramid fiber in spreading. At the combining roller, the wetted aramid fiber web was pressed into the wet coating of HYCAR® T122 that was carried on the surface of the silicone-coated release paper. As in Example 1, the coating of HYCAR® T122 appeared to penetrate or extrude through the saturated aramid fiber web without disrupting the good spread of the fiber web. The increased amount of the HYCAR® T122 acrylic dispersion that was coated onto the silicone-coated release paper was meant to offset the missing weight added from the yarn impregnator, normalizing the total amount of resinous matrix added to the fibrous web so that a similar amount of total matrix material was added to the fibrous webs in both Example 1 and Example 2.

Overall, a roll of UDT made using this hybrid coating technique was of very good quality. The yarn spread was good, the amount of resin added to the fibrous web was very consistent and the UDT was anchored down to the silicone-coated release paper well enough to allow further processing.

Next, a series of squares were cut from this unidirectional tape roll similar to Example 1 and were then further processed into cross-plied, non-woven fabrics for subsequent evaluation.

Four shoot-packs were prepared from the non-woven fabrics of both Example 1 and Example 2. Each shoot-pack consisted of 46 layers of the 2-ply non-woven fabric. Each layer measured approximately 13" by 13". The stack of 46 layers was placed into a nylon fabric carrier which was sewn closed. Each shoot-pack was then corner stitched to help the integrity of the shoot-pack during further handling and testing. The samples were numbered and weighed. The weights and other details are summarized in Table 1 below.

TABLE 1

| EXAMPLE | Sample ID | Resin Content | Layers | Total Areal Density (lb/ft$^2$) | Actual Weight (LBS) |
|---|---|---|---|---|---|
| 1 | 1A | 13.8% | 46 | 0.98 PSF (4.79 kg/m$^2$) | 1.24 (563 g) |
| 1 | 1B | 13.8% | 46 | 0.98 PSF (4.79 kg/m$^2$) | 1.27 (576 g) |
| 1 | 1C | 13.8% | 46 | 0.98 PSF (4.79 kg/m$^2$) | 1.26 (572 g) |
| 1 | 1D | 13.8% | 46 | 0.98 PSF (4.79 kg/m$^2$) | 1.25 (567 g) |
| 2 | 2A | 15.5% | 46 | 1.02 PSF (4.98 kg/m$^2$) | 1.30 (590 g) |
| 2 | 2B | 15.5% | 46 | 1.02 PSF (4.98 kg/m$^2$) | 1.28 (581 g) |
| 2 | 2C | 15.5% | 46 | 1.02 PSF (4.98 kg/m$^2$) | 1.27 (576 g) |
| 2 | 2D | 15.5% | 46 | 1.02 PSF (4.98 kg/m$^2$) | 1.28 (581 g) |

These eight samples were subjected to salt water immersion testing. In this testing, one half of the samples are shot dry with a series of 16 grain RCC Fragments according to the MIL-STD-662E testing method. The velocity of the projectiles was adjusted to achieve a mixture of complete penetrations and partial penetrations of the sample. The velocity of each shot was measured and a $V_{50}$ ((FPS) ft/second) for the sample was determined using accepted statistical analysis tools. The balance of the samples were soaked for 24 hours in a bath of a salt water solution (3.5% sea salt), and allowed to drip-dry for 15 minutes before being subjected to similar ballistic testing. The results are summarized in Table 2 below.

TABLE 2

| Example | Sample ID | Exposure | Dry Weight (LBS) | Wet Weight (LBS) | $V_{50}$ (FPS) | AVG (FPS) | Retention (Wet/Dry) |
|---|---|---|---|---|---|---|---|
| 1 | 1A | Dry | 1.24 (563 g) | N/A | 2038 (621 mps) | 2037 (620.9 mps) | N/A |
| 1 | 1B | Dry | 1.27 (576 g) | N/A | 2035 (620 mps) | | N/A |
| 1 | 1C | Wet | 1.26 (572 g) | 1.30 (590 g) | 2005 (611 mps) | 2067 (630.0 mps) | 101.4% |
| 1 | 1D | Wet | 1.25 (567 g) | 1.29 (585 g) | 2128 (649 mps) | | |
| 2 | 2A | Dry | 1.30 (590 g) | N/A | 2008 (612 mps) | 2022 (616.3 mps) | N/A |
| 2 | 2B | Dry | 1.28 (581 g) | N/A | 2035 (620 mps) | | N/A |
| 2 | 2C | Wet | 1.27 (576 g) | 1.58 (717 g) | 1882 (574 mps) | 1877 (572.1 mps) | 92.8% |

TABLE 2-continued

| Example | Sample ID | Exposure | Dry Weight (LBS) | Wet Weight (LBS) | $V_{50}$ (FPS) | AVG (FPS) | Retention (Wet/Dry) |
|---|---|---|---|---|---|---|---|
| 2 | 2D | Wet | 1.28 (581 g) | 1.67 (757 g) | 1871 (570 mps) | | |

The above data shows that the application of a thin coating of a fluorocarbon-containing resin to the aramid fiber, and coating the still wet fiber with a conventional matrix binder polymer, achieves a substantial improvement of ballistic properties for a fabric that has been submerged in salt water. In Example 1, the two dry samples had an average $V_{50}$ of 2037 ft/second (fps). The two samples that were immersed in salt water for 24 hours and then drip-dried for 15 minutes had an average $V_{50}$ of 2067 fps. This indicates that the construction and composition of Example 1 was resistant to performance degradation from the salt water exposure.

In Comparative Example 2, the two dry samples had an average $V_{50}$ of 2022 fps. The two samples that were immersed in salt water for 24 hours and then drip-dried for 15 minutes had an average $V_{50}$ of 1877 fps. This indicates that the construction and composition of Example 2 experienced some performance degradation from the salt water exposure.

Another important observation made during this testing was the apparent effect of the fluorocarbon resin on the weight gain of the samples that were subjected to the 24 hour salt water immersion. Samples 2C and 2D, which were produced using only HYCAR® T122 acrylic dispersion as the binder, gained an average of 27% weight after the 24 hour salt water immersion. Samples 1C and 1D, which were produced by applying a thin coating of Clariant NUVA® LB to the fibers before coating with the Noveon HYCAR® T122, gained an average of approximately 3%. It is evident that some of the NUVA® LB, which was applied directly to the surface of the fiber, managed to migrate to the outer surface of the composite, increasing its bulk water repellency. This was an unexpected result, with the original intention of the NUVA®LB being used specifically to protect the aramid fiber from degradation after exposure to the salt water.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant fibrous composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a first polymer layer on a surface of said one or more fibers, said first polymer layer comprising a first polymer, and a second polymer layer on said first polymer layer, said second polymer layer comprising a second polymer, wherein the first polymer and the second polymer are different, and wherein at least the first polymer comprises fluorine.

2. The ballistic resistant fibrous composite of claim 1 wherein the first polymer comprises fluorine and the second polymer is substantially absent of fluorine.

3. The ballistic resistant fibrous composite of claim 1 wherein the first polymer comprises fluorine and the second polymer comprises fluorine.

4. The ballistic resistant fibrous composite of claim 1 wherein at least one of the first polymer and the second polymer comprises a polychlorotrifluoroethylene homopolymer, a chlorotrifluoroethylene copolymer, an ethylene-chlorotrifluoroethylene copolymer, an ethylene-tetrafluoroethylene copolymer, a fluorinated ethylene-propylene copolymer, perfluoroalkoxyethylene, polytetrafluoroethylene, polyvinyl fluoride, polyvinylidene fluoride, fluorocarbon-modified polyethers, fluorocarbon-modified polyesters, fluorocarbon-modified polyanions, fluorocarbon-modified polyacrylic acid, fluorocarbon- modified polyacrylates, fluorocarbon-modified polyurethanes, or copolymers or blends thereof.

5. The ballistic resistant fibrous composite of claim 1 wherein the second polymer comprises a polyurethane polymer, a polyether polymer, a polyester polymer, a polycarbonate resin, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene /butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy resin, a novolac resin, a phenolic resin, a vinyl ester resin, a silicone resin, a nitrile rubber polymer, a natural rubber polymer, a cellulose acetate butyrate polymer, a polyvinyl butyral polymer, an acrylic polymer, an acrylic copolymer, an acrylic copolymer incorporating non-acrylic monomers or combinations thereof.

6. The ballistic resistant fibrous composite of claim 1 wherein said fibrous substrate comprises one or more polyolefin fibers, aramid fibers, polybenzazole fibers, polyvinyl alcohol fibers, polyamide fibers, polyethylene terephthalate fibers, polyethylene naphthalate fibers, polyacrylonitrile fibers, liquid crystal copolyester fibers, glass fibers, carbon fibers, rigid rod fibers comprising pyridobisimidazole-2,6-diyl (2,5-dihydroxy -p-phenylene),or a combination thereof.

7. The ballistic resistant fibrous composite of claim 1 which comprises a plurality of fibers in the form of a ballistic resistant fabric.

8. A ballistic resistant article formed from the ballistic resistant fabric of claim 7.

* * * * *